United States Patent [19]

Simmons

[11] Patent Number: 4,849,027

[45] Date of Patent: Jul. 18, 1989

[54] METHOD FOR RECYCLING FOAMED SOLVENTS

[76] Inventor: Bobby G. Simmons, 7524 S. Evanston, Tulsa, Okla. 74136

[21] Appl. No.: 40,544

[22] Filed: Apr. 16, 1987

[51] Int. Cl.[4] ..... B08B 9/00

[52] U.S. Cl. ..... 134/22.18; 134/31; 134/36; 210/696; 210/153; 261/124; 261/DIG. 26; 55/178

[58] Field of Search ..... 134/4, 6, 7, 8, 10, 134/31, 36, 22.18, 22.19, 22.1, 21; 210/696, 153; 261/124, DIG. 26, 21; 55/178

[56] References Cited

U.S. PATENT DOCUMENTS

| | | | |
|---|---|---|---|
| 2,788,065 | 4/1957 | Lockman | 159/20 |
| 3,037,887 | 6/1962 | Brenner et al. | 134/36 |
| 3,118,495 | 1/1964 | Hagby | 165/1 |
| 3,212,762 | 10/1965 | Carroll et al. | 261/124 |
| 3,214,867 | 11/1965 | Henning | 51/14 |
| 3,216,430 | 11/1965 | Besser | 134/102 |
| 3,319,704 | 5/1967 | Nasse | 165/1 |
| 3,400,754 | 9/1968 | Barbu et al. | 165/1 |
| 3,436,262 | 4/1969 | Crowe et al. | 134/10 |
| 4,113,008 | 9/1978 | Treplin et al. | 165/95 |
| 4,127,160 | 11/1978 | Joffe | 165/1 |
| 4,133,773 | 1/1979 | Simmons | 252/359 E |
| 4,143,702 | 3/1979 | Barr, Jr. | 165/1 |
| 4,209,063 | 6/1980 | Babish et al. | 165/95 |
| 4,366,855 | 1/1983 | Spitz | 165/95 |
| 4,391,327 | 7/1983 | DeCarlo | 166/307 |
| 4,419,141 | 12/1983 | Kunkel | 134/22.12 |
| 4,614,236 | 9/1986 | Watkins | 166/304 |

*Primary Examiner*—H. M. S. Sneed
*Assistant Examiner*—Sharon T. Cohen
*Attorney, Agent, or Firm*—Richards, Harris, Medlock & Andrews

[57] ABSTRACT

A method for using a foamed liquid for cleaning and/or inerting a vessel is described which allows for continuous recycling of the foam and its breakout liquid and gas components into regenerated foam which is continously directed back into the vessel.

14 Claims, 3 Drawing Sheets

METHOD FOR RECYCLING FOAMED SOLVENTS

TECHNICAL FIELD

This invention relates to the field of chemical foam cleaning of industrial equipment.

BACKGROUND OF THE INVENTION

Foam cleaning is a chemical cleaning process for removal of water hardness scales, corrosion deposits, pre-operational deposits and organic foulants from industrial equipment. A cleaning solvent is employed that is selected to satisfactorily dissolve the objectionable scale or foulant. A surfactant is added to the solvent to promote foaming, and the resulting solvent/surfactant liquid is foamed with a gas to generate a much larger volume of foam. Forcing a gas under pressure into the body of the liquid is one method that has been used to create foam, which is then introduced into the equipment to be cleaned by the constant pressure of the gas. The foam is allowed to flow through the vessel or process equipment to be cleaned. In the conventional process, the foam is passed through the equipment only one time. Apparatuses for foam generation for use in methods for chemical foam cleaning of vessels are described in U.S. Pat. No. 3,212,762 to Carroll, et al. and U.S. Pat. No. 4,133,773 to Simmons.

The foam cleaning process is particularly useful for cleaning such equipment as gas lines which cannot support the weight of liquids, condensers used in the utility industry which employ thousands of tubes, and other heavy-duty equipment such as tanks, coils, tubing and the like.

A disadvantage of the conventional method of employing foamed solvents is that it is wasteful. Since chemical cleaning is dependent on reaction rate and time, much of the foamed solvent which flows through the equipment remains unreacted. Additionally, the "used" foamed solvent may present an environmentally undesirable waste product and, since the conventional once-through process also requires a large quantity of foamed solvent, a large quantity of waste is generated that may present a disposal problem.

Another industrial cleaning problem is the decontamination of equipment which may contain radioactive material. While foamed liquids are effective for cleaning foulants from many types of structures, it is desirable to generate as little waste product as possible in the cleaning operation because the disposal of radioactive cleaning material must be carefully monitored. It is further of interest to reduce the release of gases in the cleaning process for environmental reasons.

There have been attempts to reuse foamed solvent after it has been employed for cleaning. However, prior methods have not been successful in efficiently using solvent and concurrently reducing waste product.

One prior method for reusing foamed solvent requires the use of a collection vessel or reservoir which is open to the atmosphere. When foam is introduced to the vessel being cleaned and begins to react on the scale to be removed, it begins to naturally break-down into a two-phase composition as a gas and a liquid. The term "half-life" is used to describe the amount of time it takes to recover one-half of the original volume of liquid from a measured volume of foam. In the conventional process, the foam is passed through the vessel, then the remaining foam, as well as the break-down products from the foam, are discharged into the collection vessel.

The foam can be further broken into its separate liquid and gas components by use of a chemical substance or admixture known as "foam breaker" or an "antifoam." The gas thus generated, termed "break-out gas" is allowed to escape to the atmosphere. The liquid thus generated, in combination with the natural break-down liquid of the foam, is termed "break-out liquid." The "break-out liquid" is pumped to a foam generator where it is mixed with additional nitrogen or air for foam regeneration. This break-out liquid, since it is contaminated with antifoam materials, is more difficult to foam and additionally has a shorter half-life then the original foam; therefore, additional foaming agent or stabilizers must usually be added in order to sustain good foam stabililty. Break-out liquid that is severely contaminated with antifoaming agent may not refoam. A collection tank of sufficient size is required in this process, since it is not unusual for foam to rapidly fill the collection vessel and overflow, causing pollution to the immediate area.

Another method for reusing solvent employs a collection tank of sufficient size to allow foam breaking to occur without the use of an antifoam. This method requires an even larger collection tank than the method in which antifoam is used, because the foam occupies a larger volume when not chemically broken. This method is disadvantageous as it is often difficult to predict how large of a collection tank will be required for a particular job. Even if this can be predicted, space constraints at the job site may preclude employment of a sufficiently large tank.

Another prior art attempt to reuse foamed solvent was disclosed by Crowe, et al., in U.S. Pat. No. 3,436,262. The '262 system employs a liquid comprising a solvent in combination with a foaming agent and a foam stabilizer that is foamable by the use of heat. The foaming agent must be gaseous in the foaming unit and liquid in the collapsing unit according to the '262 patent. A heating unit must be employed to cause the liquid to foam. After the foam is passed through the vessel to be cleaned, it is collected in a foam collapsing unit where it is cooled to at least 60° F., which cooling condenses the foam into a liquid. The liquid can then be heated to form a foam. The Crowe et al. method is suitable for some applications, but is disadvantageous due to the requirement for the foaming agent and stabilizer, the need to heat and cool the foam and the need to break the foam completely before refoaming.

Thus, prior art attempts to reuse solvent followed the procedure of breaking down foam completely, and attempting to refoam it.

Prior art methods of using and reusing foamed solvents generally require the addition of chemicals such as antifoam, additional foaming agent, and or foam stabilizers. Therefore, the attempt to reuse the solvent may not be economically advantageous because of the added cost of the necessary treating chemicals. The conventional once-through process also may require costly quantities of inert gas when inert gas is needed for the application.

Present methods for employing foamed solvents for cleaning also undesirably produce very corrosive solutions that may attack the material from which the equipment to be cleaned is made. For example, hydrochloric acid is commonly employed to remove iron oxide and copper oxides from equipment. $Fe^{++}$ is generated by dissolution of iron oxide and is oxidized to the higher valance state $Fe^{+++}$ by contact with the oxygen in the air. When $Fe^{+++}$ comes into contact with base metal such as $Fe^{\circ}$, corrosion occurs according to the following mechanism:

$$2Fe^{+++}+Fe^{\circ}\rightarrow 3Fe^{++}$$

Further contact with the oxygen in the air generating the corrosive $Fe^{+++}$:

$$3Fe^{++}+O_2\rightarrow 3Fe^{+++}$$

$Cu^{++}$ is stabilized with the $C1^{-}$ ion from hydrochloric acid, causing severe corrosion to copper according to the following mechanism:

$$Cu^{++}+Cu^{\circ}\rightarrow 2Cu^{+}$$

Contact with the oxygen in the air regenerating the corrosive $Cu^{++}$:

$$2Cu^{+}+O_2\rightarrow 2Cu^{++}$$

In order to avoid the corrosion associated with aeration of the solvent in the conventional process, nitrogen, an inert gas, may be substituted for standard air. Continuous use of nitrogen, however, adds significantly to the cost of the job. Reducing agents can also be used to reduce the corrosivity of the foamed solvent, but due to the "once-through" process, the cost is prohibitive. In addition, some industrial reducing agents such as stannous chloride, are themselves potential environmental hazards.

Foamed solvents, while very useful for cleaning, may also be difficult to control. It is not always possible to predict how quickly a vessel may be filled with foam. There may be overflow from the vessel which presents a risk of environmental contamination and exposure of workers to hazardous material. In addition to the spill hazard from collection tank overflow already discussed, there is a risk of air pollution. During a conventional foam breaking process, toxic or flammable vapors from volatile acids, organic stabilizers and reaction gases can be released to the atmosphere, creating air pollution, health hazards, and other safety risks. This is of particular concern when toxic or flammable gas is released into a closed building.

The need to inert a vessel is also a common industrial requirement. For example, it may be desirable to displace toxic or flammable gases that have been formed or collected in a closed vessel. Present methods of inerting generate undesirably large volumes of waste product or utilize vast expensive quantities of inert gas. In the former situation, water is generally employed to displace explosive vapors. The waste water contains hazardous material which must then be disposed of properly. In the latter case, continuous purging with an inert gas is cumbersome and costly.

The quality of the foam at any given time in the cleaning process also is a consideration. Foam quality is defined as the ratio of gas volume to the total volume or $V_g/V_t X$ 100 or $$\frac{\text{Volume of Gas} \times 100}{\text{Volume of Gas} + \text{Volume of Liquid}}$$

The lower the quality the greater the moisture content. The higher the quality the lower the liquid content. "Wet foams" are defined as low quality foams while "dry foams" are of high quality. Foam is a compressible fluid; therefore (neglecting the solubility of gas in the solution and liquid expansion), the quality of foam at some other pressure can be calculated using Boyle's law. The ideal cleaning foam contains enough solvent in the liquid phase to continuously bathe the scale or foulant with solvent. Scale dissolution occurs in the liquid phase by a reaction of the solvent with the scale. A foam that is too dry (high quality) will not contain a sufficient amount of solvent for scale dissolution to occur, therefore, a good cleaning foam normally is equal to or less than "95" quality.

Thus, there has been a continuing need for a method for using and reusing foamed solvent which allows use of a lesser amount of inert gas where an inert gas is desirable or necessary, which allows for more efficient use of solvent, which eliminates the need for a large collection tank to break-down foam, which eliminates the need to break the foam down completely before refoaming, which allows for maintaining a foam of effective quality throughout the vessel to be cleaned, which can be conducted in a contained system to prevent the escape of hazardous or radioactive material, and which allows for control of the foam during the cleaning operation.

A method has now been found for using and recycling foamed solvents which obviates the problems of the conventional method discussed above. This new process may be employed in a closed or open system. It allows for recycling of foam and regeneration of natural break-down products of foam into new foam without danger of vessel overflow and subsequent ground pollution. It also allows recycling without danger of air pollution. In the herein disclosed process, recycling is accomplished by reuse of the foaming gas, reuse of the solvent, and reuse of the foamed liquid. It allows for less solvent to be used for a particular cleaning job. This process also reduces or eliminates the need for expensive or undesirable additives such as antifoaming agents, additives needed to refoam antifoam-contaminated liquid, and foam stabilizers.

The herein disclosed process is additionally advantageous as less personnel are required for performance of the cleaning job. Cleaning can be accomplished unattended once the process is set up since provision is made for foam control. This process can utilize both inert gas and reducing agents for corrosion control, but advantageously requires less inert gas and/or reducing chemicals because it provides for reuse of the gas and foamable liquid components. Expensive metering equipment for continuous blending of gas and liquid is also not required. The apparatus required for this new method can be assembled as a complete package on a single skid for use as a closed system or open system hookup.

It is further envisioned that the process will be especially useful for nuclear and environmental decontamination because reduced waste product from the cleaning operation is generated. This will reduce the need to dispose of large quantities of radioactive solvent. In addition, the radioactive equipment may be decontaminated with containment of hazardous materials because the process may be operated as a closed system.

In the process of inerting a vessel, foam may be generated from a fluid such as water or other suitable liquid, foaming agent, and an inert gas to displace undesirable vapors from a vessel. The foam initially displaces the vapors which are released through an opening in the vessel. Less waste is generated by the recycle of the foam and the continuous presence of foam in the vessel prevents additional vapors from forming from solvent that may have been contained in the vessel, and re-entry of air. This provides a safety factor when welding or other hot work must be performed in the vicinity of the vessel.

SUMMARY OF THE INVENTION

A process is disclosed for using and reusing a foamed liquid which employs a means for effecting continuous intimate contact between a foamed liquid and a vessel to be cleaned and a means for reusing a cleaning foam without artificially breaking it down into its liquid and gas components with antifoam.

In one embodiment, a suitable solvent for the particular cleaning job is mixed with a foaming agent to form a foamable liquid. The foamable liquid may also, but is not required to, contain a carrier such as water and/or other treatment chemicals such as anticorrosives. The foamable liquid is introduced into a compressible fluids pump effective to foam the mixture, or in the alternative is pumped through a conventional foam generator, the resulting foam is then forced into the vessel to be cleaned, and as the foam naturally breaks into liquid and gas components, these are recycled with any remaining foam through the compressible fluids or pump. In the alternative, the gas and foam only may be suctioned through the compressible fluids pump and then mixed with the break-out liquid to form a mixture that is then pumped through a foam generator. The regenerated foam is then pumped into the vessel. Thus, the continuous recycling of the foam and its components through the vessel to be cleaned comprises a means for effecting continuous intimate contact between the vessel and the foam as well as serving as a means for reusing the cleaning foam.

Another embodiment of the invention employs a suction hose as a means for effecting continuous intimate contact between the vessel and the foam. In this embodiment, foam is pumped into an open vessel in which a suction hose is positioned. The suction hose draws air and a high quality "dry" foam into a compressible fluids pump. The high quality foam is mixed with break-out liquid supplied to the pump as service liquid. If additional liquid is required to lower the quality and make a more ideal cleaning foam, additional break-out liquid can be added downstream of the compressible fluids pump in a mixing tee prior to entering a foam generator. The resulting foam is recirculated into the vessel. Foam remains in continuous contact with the vessel.

In a third embodiment, a foam generator is placed inside the vessel of a closed system. The foam is generated in the vessel by placing foamable liquid in the vessel and pumping air through the internal foam generator, such as a sparger. The resulting foam gradually breaks down into break-out liquid and break-out gas and the break-out liquid flows or is pumped to a mixing tee where it is mixed with break-out gas and foam that was collected from the vessel and pumped through a compressible fluids pump. After the liquid, gas and foam are remixed, they are pumped through a foam generator, foam is generated and recirculated to the vessel.

In a fourth embodiment, foam is generated internally in an open system. Liquid is introduced to a vessel and the desired gas is pumped through a sparger or foam generator installed in the vessel. The liquid becomes gasified into foam and thus flows to an area of lower pressure in the vessel. As the foam degrades, the break out liquid flows back into the foaming area where it is regenerated to foam by being mixed with break-out gas directed through the sparger.

In a fifth embodiment, foam is used to displace hazardous gases from a vessel and continuously regenerated to keep the vessel filled with foam for a desired period of time.

DETAILED DESCRIPTION

Figure 1:
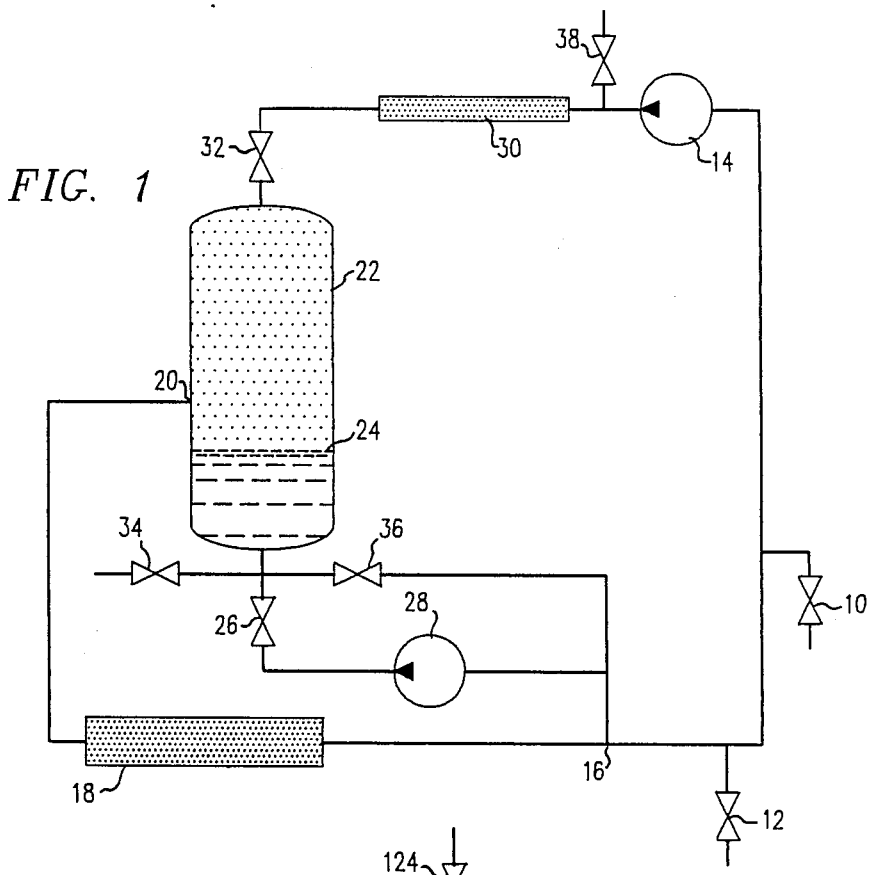
FIG. 1 is a diagrammatic representation of the process for employing foam generated externally to a closed vessel.

The success of the present invention will be better understood in context of the normal complete operation.

The process for using foamed liquids is initiated by assessing the volume of the vessel to be cleaned. It should be understood that the term "vessel" refers to any structure which may be a cylindrical tank, a section of a surface condensor which may contain several thousand tubes, or any other piece of industrial equipment conducive to foam cleaning or displacement of undesirable gases by foam. From the estimation of the vessel volume, a calculation of the amount of foam needed to fill that volume is made. The composition of the equipment to be cleaned and the scale or foulant to be removed is determined by suitable laboratory analysis or by reference to known parameters such as the type of foulant or deposit generated by the process normally carried out by the equipment to be cleaned and the material specifications for the equipment. The amount of scale present in the equipment is also estimated.

A solvent for a cleaning operation is selected that will effectively dissolve the scale or foulant present in the equipment and ideally to be compatible with the materials of construction in the equipment to be cleaned. By compatible it is meant that the solvent should ideally remove the foulant or scale while doing little or no damage to the equipment. For example, low chloride solvents are generally preferred for stainless steel cleaning. However, hydrochloric acid is commonly used as a foamable liquid, even though other liquids may be more compatible with the materials of construction, because of its relatively low cost. While the present invention does not preclude use of hydrochloric acid as a foamable cleaner for stainless steel, the present method allows selection of a more suitable solvent since less solvent is needed to accomplish the same cleaning objective, thus reducing the importance of cost in solvent selection. The solvent may be an organic solvent, an organic acid, a mineral acid, or any other type of chemical suitable for the particular job. Sequestering agents, chelants and/or other additives or decontaminants for the removal of scale and foulants may be added to the solvent. The solvent is further selected to be foamable with gas, either alone or in combination with a foaming agent.

A foaming agent is preferably added to the solvent. This may be any suitable surfactant chemically appropriate for the particular solvent selected, in an effective amount to allow the solvent to be foamed. In addition, water and/or other treatment chemicals may be added. The resulting mixture of solvent and other additives is herein referred to as a foamable liquid.

The amount of solvent to be used for a particular cleaning job is estimated from the vessel volume determination, the amount of the scale or foulant to be removed, and the desired contact time of the foamed solvent and equipment. A laboratory test may be conducted to obtain an estimate of the dissolve time of a particular foulant by the selected liquid. The chemical reaction mechanism between the solvent and foulant may be assessed to determine the stoichiometric parameters required. Generally, the volume of the vessel is multiplied by 10% to ascertain the amount of foamable liquid needed to produce adequate foam. However, more or less liquid may be used depending on the quality of the foam. The term "quality of foam" refers to the ratio of the gas phase to the liquid phase of the foam or whether it is a "wet" foam or a "dry" foam.

The foamable liquid may be pumped by a suitable liquid pump effective to move the liquid into the vessel to be cleaned. This liquid is then directed to a compressible fluids pump where it is mixed with a desired gas or to a mixing tee where it is mixed with the desired gas to form a foamable mixture which is then directed through a foam generator to produce foam. In the alternative, the foamable liquid is foamed before being directed to the vessel for the first time by any effective means for foam generation.

The liquid may be initially foamed by any suitable apparatus. To generate foam, the foamable liquid may be mixed with gas, then pumped through a foam generator. Examples of suitable foam generators are described in U.S. Pat. Nos. 3,212,762 and 4,133,773; however, any device suitable for mixing a foamable liquid and a gas may be employed. An inline foam generator, such as a static mixer may be used to generate foam. Foam may be generated by a compressible fluids pump which can be a peristaltic type pump, a diaphragm pump, a sliding vane pump rotary blower, a liquid piston type rotary blower or any vacuum pump or compressor capable of performing this operation. A centrifugal pump can also be used as the compressible fluids pump in this process. An example of a suitable pump for certain operations is a liquid ring compressor pump such as manufactured by Sihi, Grand Island, N.Y. (KPH pump series 60520). The pump is selected on the basis of corrosion resistance to the liquid used, the volume of the vessel that must be filled with foam, and the estimated half-life of the foam. Half-life of foam may be determined by known laboratory methods. The foam generated by the compressible fluids pump may be directed through a conventional in-line foam generator if desired to refine the foam, or it may be employed as is.

The present invention also is useful for inerting a vessel with foam. A vessel may need to be subjected to occasional maintenance procedures such as welding or other hot work. In addition, welding in the vicinity of a vessel containing flammable liquid or volatile organic vapors is dangerous due to the hazard of explosion or fire. In the process of the present invention, a fluid to be foamed is selected not to clean the vessel, but to provide the desired interaction with the materials in the vessel. For example, water may be selected as the fluid so as to be completely inert to the substances in the tank. In another instance, an alkaline foam may be desired to counteract such hazardous gases in the vessel as $H_2S$. A suitable surfactant is added to the fluid to form a foamable liquid. The foam is generated in one of two ways. The foamable liquid may be initially introduced to the vessel, then pumped from it by a liquid pump to a mixing tee where it is mixed with an inert gas, such as nitrogen. The mixture is then pumped through a foam generator by pressure from a compressible fluids pump to make the inert foam. The vessel is then completely filled with foam which displaces the undesirable vapors in the vessel. The vapors are released through an opening in the vessel. The foam naturally degrades into break-out liquid and break-out gas which are reused to regenerate foam. Thus the process continually recycles the inert gas into foam.

Alternatively, the foam may be generated externally to the vessel by creating foam in the line leading to the vessel and introducing foam to the vessel to displace the undesirable vapors.

This invention, when used for cleaning a vessel, employs a means for effecting continuous intimate contact between the cleaning form and the scale or foulant to be removed. When used for inerting, the method employs a means for effecting continuous inerting of a vessel by keeping the vessel completely filled with foam generated with an inert gas.

In one aspect of the invention, a suction hose serves as a means for effecting continuous intimate contact between the vessel and the foam by preventing overflow of the foam and thus allowing longer foam/vessel contact. The suction hose is placed at the desired level of the foam in an open vessel. Foamed solvent is continuously pumped into the vessel and recycled at the level desired. Neglecting reaction gases, the amount of foam generated is limited to the quantity of gas and dry foam entering the suction; therefore, once the vessel has been filled to the suction level of the hose, the volume remains constant. This method is suitable for use where an open vessel is to be inerted and it allows the foamed solution to completely fill the vessel and keep it filled with inert foam. The natural degradation products of the foam (break-out liquid and break-out gas) are continuously collected and used to regenerate foam. The suction hose collects inert gas and dry foam and recirculates these components to a compressible fluids pump. The breakout liquid is also collected and utilized to make new foam by mixing it with the recovered gas and/or dry foam in a compressible fluids pump to form foam and/or putting the resulting mixture through a foam generator.

In another aspect, the means for effecting continuous intimate contact is a system with a pump in which a desired quantity of foam is continuously pumped through the vessel to be cleaned by continuous regeneration of foam from the natural degradation products. The natural degradation products of the foam, that is its gas and liquid components of foam and foam that has not broken down, are retrieved and used to regenerate foam by use of a compressible fluids pump heretofore described which continually regenerates the foam and recirculates it through the vessel and/or a separate foam generator.

Referring now to FIG. 1, a foamable liquid introduced at valve (10) and a regulated gas introduced at valve (12) are forced by pressure to mixing tee (16) where the gas and liquid are mixed. The mixture of gas and liquid then is directed through foam generator (18) which generates foam. The foam then flows at inlet (20) into vessel (22) which is the vessel to be cleaned. Preferably, the foam is discharged into the vessel above the estimated liquid level (24) in the vessel, but it may be introduced at any convenient point in the vessel. When the foam enters the vessel (22), the foam begins to break-down into a two-phase composition as a gas and a liquid. The rate of break-out is dependent on the foam half-life, i.e., the amount of time it takes to recover one-half of the original quantity of liquid from a measured volume of foam. As the foam breaks, the liquid phase flows to the low point regulated by liquid level valve (26) then is pumped by liquid pump (28) (or in the alternative flows by gravity flow) through valve (36) to the mixing tee (16) where it is mixed with gas and pumped into the foam generator (18) for foam regeneration. When foam or a positive flow has been observed at flow indicator (30), the air vent valve (38) is closed, a compressible fluids pump (14) takes suction from valve (32) and delivers the break-out gas and dry foam to the mixing tee (16) where it is mixed with liquid and regenerated into foam at the foam generator (18). A positive pressure is maintained on the vessel (22) from a regulated gas source discharging into valve (12). The vessel (22) may be equipped with either a vacuum breaker or a pressure relief valve for protection of vessel (22) from mechanical failure, if required.

Alternatively, the foamable liquid may be initially introduced directly into vessel (22), through valve (34). It then is pumped through valve (26) by liquid pump (28) or it flows by gravity, through valve (36) to mixing tee (16) where it is mixed with gas introduced at valve (12). The resulting mixture then is pumped through foam generator (18) to vessel (22) as previously described.

Figure 2:
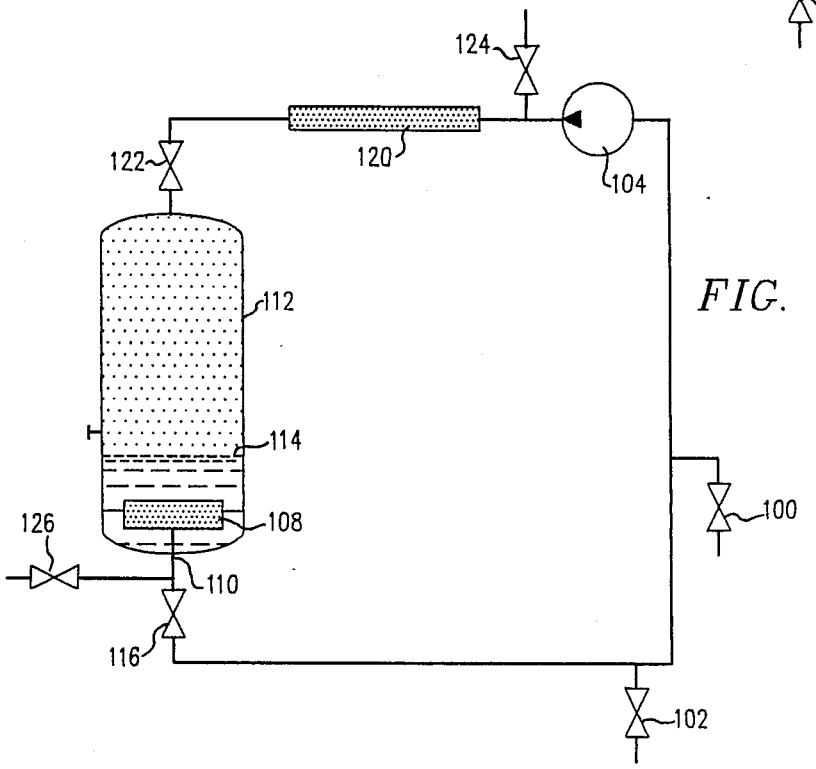
FIG. 2 is a diagrammatic representation of the process wherein foam is generated internally in a closed vessel.

Referring now to FIG. 2, a sparger or foam generator (108) is installed in the vessel (112) below the estimated liquid level (114). The initial liquid is introduced through valve (100) or any convenient connection to vessel (112). Foam is generated by discharging a gas into valve (102) and through liquid valve (116) and inlet (110) through sparger or foam generator (108) inside vessel (112) through valve (122) until foam or a positive flow of gas is detectable at flow indicator (120). Air vent valve (124) is closed, a compressible fluids pump (104) takes suction from valve (122) and discharges the break-out gas and dry foam to the foam generator (108), for regeneration. Vessel (112) is preferably equipped with a vacuum breaker or a pressure relief valve, as the case may require, in order to prevent mechanical damage from pressure.

Figure 3:
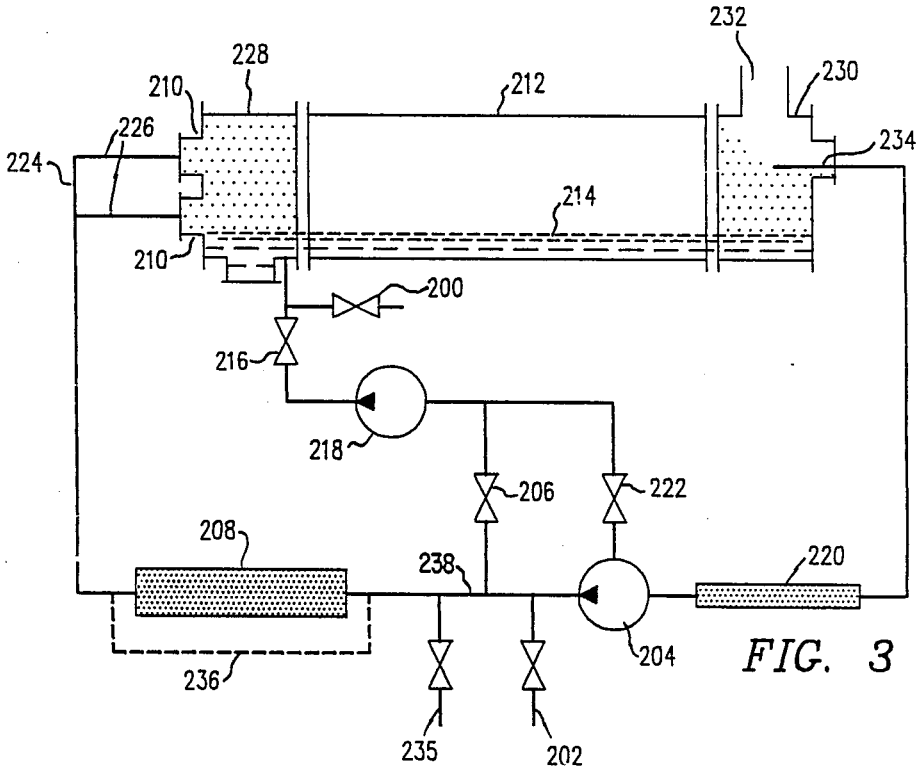
FIG. 3 is a diagrammatic representation of the process for foam cleaning of an open system.

Referring now to FIG. 3, a chemical cleaning solution containing a foaming agent or surfactant is pumped into vessel (212) (surface condenser) through valve (200). The volume of liquid pumped into the vessel is usually equal to ten percent of the total volume of the vessel but can be more or less depending on the quality of the foam. Liquid pump (218) pumps the chemical cleaning solution from the bottom of vessel (212) through valve (216) and discharges the fluid through valve (222) into the compressible fluids pump (204) to serve as service liquid for the pump and to utilize the pump as a foam generator. The foam generated in compressible fluids pump (204) then is pumped into the vessel through foam generator (208) or via bypass (236). In the alternative, the foamable liquid is directed from vessel (212) through foam quality adjustment valve (206) to mixing tee (238) where it is mixed with discharge gas from the compressible fluids pump (204) or with inert gas introduced through valve (202) prior to entering foam generator (208). Foam discharges from the foam generator (208) into a header (224) equipped with discharge hoses or pipes (226) for introduction of foam into the inlet (210) of inlet water box (228) of vessel (212). When the inlet water box is filled with foam, the foam moves through the condenser tubes of the vessel (212) where it contacts the objectionable scale or foulant. The liquid phase of the foam continuously wets the scale with cleaning solution. The scale is removed from the heat transfer surface of the tubes by scale dissolution into the liquid phase of the foam and by drag forces exerted by the foam against sloughed particles and insoluble debris.

As the foam passes through all the condenser tubes, the effluent foam collects in the outlet box (230) of the surface condenser (212) shown open to the atmosphere. The open manway (234) in the outlet box allows the chemical cleaning supervisor to observe the flow of foam through the tubes and to ascertain that sufficient flow rate has been achieved to provide flow through all the tubes. During the start up period, the compressible fluids pump (204) pumps air or inert gas from the condenser outlet box until the foam level reaches the same elevation as the suction hose or pipes. When this elevation is reached, the compressible fuids pump starts to recycle the foam. If an inert gas was introduced initially at valve (202), the compressible fluids pump (204) recycles both the liquid phase and the inert gas phase of the foam. The process is continued until the solvent is spent on the scale. The spent solution is discarded for disposal by an environmentally acceptable process and fresh cleaning solution is introduced to vessel (212), if needed, to repeat the cleaning process until chemical analytical tests or inspection indicate the vessel is clean.

FIG. 3 shows vessel (212) to be open to the atmosphere but it can be closed once it has been determined that all tubes are flowing, and the air has been displaced.

Figure 4:
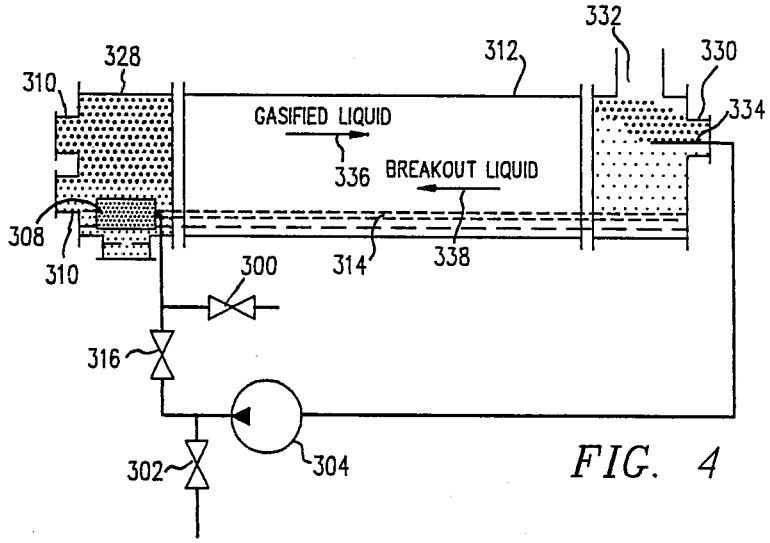
FIG. 4 is a diagrammatic representation of the process for foam cleaning of an open system in which foam is generated internally in the vessel.

Referring now to FIG. 4, a liquid is first introduced into vessel (312) through valve (300). Compressible fluids pump (304) pulls gas from outlet box (330) of vessel (312) and pumps the gas through valve (316) and foam generator or sparger (308) installed in inlet box (328) of vessel (312). The liquid becomes gasified and this gasified liquid rises in the inlet box (328) above the original level of the liquid. The gasified liquid then flows in direction (336) through upper tubes (337) of inlet box (328) to the outlet box (330) because of differential pressure between the inlet box and the outlet box. The gasified liquid is naturally degraded into break-out liquid and break-out gas as it flows through vessel (312). The break-out liquid is expelled into outlet box (330) and flows in direction (338) back to inlet box (328) where air is again pumped through it to form gasified liquid.

As an alternative, inert gas may be introduced through valve (302) which is forced by compressible fluids pump (304) through valve (316) and sparger (308).

Figure 5:
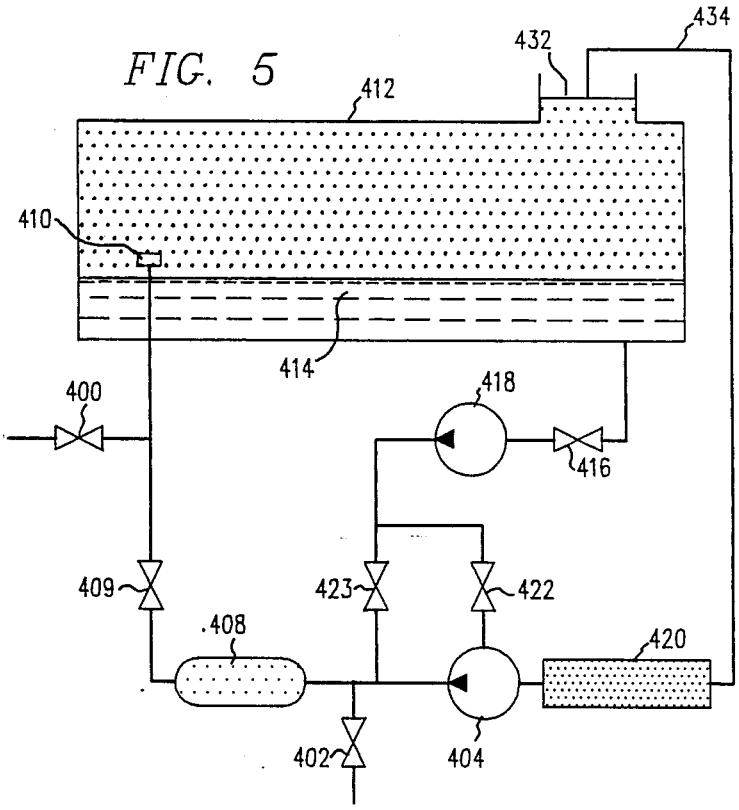
FIG. 5 is a diagrammatic representation of the process for inerting a vessel with foam.

Referring now to FIG. 5, which demonstrates one embodiment of the use of foam to inert a vessel with recycling of inert gas and fluid, a fluid is introduced through valve (400) into vessel (412). The fluid is pumped from the bottom of the vessel (412) by liquid pump (418) through drain valve (417). Inert gas is introduced through gas valve (402) where it mixes with break-out liquid from pump (418) prior to entering foam generator (408). Foam exits foam generator (408) through valve (409) through foam inlet tee (410) which disperses the foam into vessel (412). The foam fills vessel (412) and displaces air and explosive vapors out manway (432). When vessel (412) is filled with inert foam, compressible fluids pump (404) takes suction from suction hose (434) and picks up dry foam and break-out inert gas from vessel (412). The dry foam and inert gas is mixed with break-out service liquid delivered by liquid pump (418) to compressible fluids pump (404) and through foam quality regulating valve (423) The resulting mix enters foam generator (408) to repeat the cycle.

When the foam initially fills vessel (412), it displaces explosive or hazardous vapors in the vessel which are allowed to escape through manway (432). Once the undesirable vapors are displaced with inert gas foam, the vessel remains filled with recycle foam to prevent re-entry of air that could mix with volatile organic vapor and form an explosive mixture.

EXAMPLE 1

An 1100 gallon tank was used to demonstrate the recycle concept of the invention. 100 gallons of water containing approximately 0.1% by volume of a foaming agent was mixed to form a solution. The solution was pumped to a liquid ring (LR) compressor in place of a service liquid. A 4-inch suction hose was connected to the suction connection of the LR compressor. The suction end of the 4" hose was positioned near the top of the 1100 gallon tank. The LR compressor was equipped with two two-inch discharge hoses equipped with foam generators or static mixers.

The LR compressor was started and a small diaphragm pump was used to pump the water/foaming agent solution to the LR compressor. The tank rapidly filled with foam up to the level of the 4-inch suction hose. The suction hose in position prevented the tank from overflowing. The discharge hoses could be observed discharging foam. The level of foam in the tank could be controlled by raising and lowering the suction hose. During recycle of the foam, the discharge pressure increased slightly due to the density effect of the recycle foam as compared to air.

The above test was repeated using four two-inch discharge hoses with equal success.

Description of Test Equipment:

Liquid Ring Compressor:

Sihi KPHB 60520, 50 HP motor - 1775 RPM 460 Volt 3 Ph 60 Cy four-inch Suction AND four-inch discharge, one-inch inlet on each end of compressor for service liquid injection. Maximum capability of the pump was utilized.

Circulation Tank:

4.042 foot wide by 6.46 foot long, volume approximately 1100 gallons. Volume per foot=195.3 gallons

Diaphragm Pump

Wilden M2
10 gallons/min at 200 strokes/min

Water Flow Meter totalizer only
3196 Goulds pump powered by diesel hoses

Other two-inch industrial hose
one and one-fourth inch industrial hose
four inch vacuum hose
two-inch static mixers from foam generator.

I claim:

1. A method for cleaning scale or foulant from a vessel with foam, comprising the steps of:
   (a) providing a foam to said vessel; and
   (b) providing a means for effecting continuous intimate contact between said foam and said scale or foulant, said means for effecting continuous intimate contact comprising a means for continuously removing and collecting break-out gas and dry foam from said vessel, a means for mixing said break-out gas and dry foam with a foamable liquid to continuously regenerate foam, and a means for returning said regenerated foam to said vessel.

2. A method according to claim 1, in which said means for continuously removing break-out gas and dry foam is a suction hose or pipe connected to an appropriate pump.

3. A method according to claim 1, wherein said means for mixing said break-out gas and dry foam with a foamable liquid and for continuously regenerating foam is a pump for directing said break-out gas and dry foam through a sparger submersed in said foamable liquid in said vessel.

4. A method according to claim 1, wherein said means for mixing said break-out gas and dry foam with a foamable liquid and for continuously regenerating foam comprises a compressible fluids pump.

5. A method according to claim 4, wherein said means for mixing said break-out gas and dry foam with a foamable liquid and for continuously regenerating foam further comprises a foam generator.

6. A method according to claim 1, wherein said foamable liquid is break-out liquid from the original foam.

7. A method for cleaning scale or foulant from a vessel with foam, comprising the steps of:
   (a) mixing a foamable liquid and a gas to form a foamable mixture;
   (b) directing said foamable mixture through a means for generating foam to form a foam;
   (c) causing said foam to flow into a vessel to be cleaned;
   (d) allowing said foam to react with said scale or foulant, said foam naturally breaking down into a break-out liquid and a break-out gas;
   (e) continuously collecting said break-out liquid and said break-out gas as they are formed;
   (f) continuously mixing said collected break-out gas and break-out liquid to form a mixture of said break-out liquid and break-out gas;
   (g) directing said mixture of break-out liquid and break-out gas through a foam generator to form regenerated foam;
   (h) directing said regenerated foam into said vessel.

8. A method according to claim 7, wherein said foam generator comprises a compressible fluids pump.

9. A method according to claim 7, wherein said foam generator comprises a compressible fluids pump and an additional foam generator which receives foam from said compressible fluids pump.

10. A method for cleaning scale or foulant from a vessel having an internal foam generator or sparger with foam, comprising the steps of:

(a) introducing a quantity of liquid into the vessel to be cleaned above the level of said sparger;
(b) pumping an effective amount of gas through said sparger to foam said liquid into a cleaning foam;
(c) allowing said cleaning foam to react with said scale or foulant, said foam naturally breaking down into a break-out liquid and a break-out gas;
(d) continuously collecting said break-out gas and repumping said gas through said sparger to regenerate foam.

11. A method for cleaning scale or foulant from a vessel with foam, comprising the steps of:
(a) pumping a foamable liquid into a vessel;
(b) pumping said foamable liquid from said vessel into a compressible fluids pump and thereby mixing said foamable liquid with air to form foam;
(c) pumping said foam into said vessel where said foam reacts with the scale or foulant and breaks down into break-out liquid and break-out gas;
(d) continuously collecting said break-out liquid and break-out gas from said vessel and pumping each through said compressible fluids pump to form a regenerated foam; and
(e) directing said regenerated foam into said vessel.

12. A method according to claim 11, wherein said foam generated by said compressible fluids pump is directed through a second foam generator to refine the foam before said foam is directed to said vessel.

13. A method for inerting a vessel with foam, comprising:
(a) introducing a fluid into said vessel;
(b) pumping said fluid from said vessel to a mixing area;
(c) mixing said fluid with an inert gas in said mixing area to form a foamable mixture;
(d) directing said foamable mixture through a foam generator to form inert foam;
(e) directing said inert foam into said vessel in an effective amount to displace undesirable vapors from said vessel;
(f) continuously pumping break-out liquid and break-out gas from said vessel;
(g) mixing said break-out liquid and break-out gas to form a foamable mixture;
(h) foaming said foamable mixture to form regenerated foam; and
(i) returning said regenerated foam to said vessel.

14. A method for inerting a vessel with foam, comprising:
(a) introducing an effective quantity of inert foam into a vessel to displace undesirable vapors from said vessel;
(b) continuously collecting break-out gas and break-out liquid from said vessel;
(c) mixing said break-out liquid and break-out gas to form a foamable mixture;
(d) foaming said foamable mixure to form regenerated foam; and
(e) returning said regenerated foam to said vessel.

* * * * *